United States Patent [19]

Zoleski et al.

[11] 4,358,387

[45] Nov. 9, 1982

[54] CYLINDER LUBRICATING OIL COMPOSITION

[75] Inventors: Benjamin H. Zoleski, Beacon; Rodney L. Sung, Fishkill; Stephen A. Levine, Fishkill; William P. Cullen, Fishkill, all of N.Y.

[73] Assignee: Texaco Inc., White Plains, N.Y.

[21] Appl. No.: 291,582

[22] Filed: Aug. 10, 1981

[51] Int. Cl.[3] ..... C10M 1/40

[52] U.S. Cl. ..... 252/33.4; 252/50; 252/51.5 A

[58] Field of Search ..... 252/33.4, 50, 51.5 A

[56] References Cited

U.S. PATENT DOCUMENTS

| | | | |
|---|---|---|---|
| 2,320,392 | 6/1943 | White | 252/51.5 A X |
| 2,468,012 | 4/1949 | Isbell | 562/553 |
| 2,810,752 | 10/1957 | Freese | 562/553 |
| 3,003,961 | 10/1961 | Andress, Jr. et al. | 252/51.5 A X |
| 3,116,252 | 12/1963 | Beretvas | 252/51.5 A |
| 3,123,570 | 3/1964 | Bonner et al. | 252/32.7 E |
| 3,390,081 | 6/1968 | Floeck | 252/32.7 E |
| 3,856,687 | 12/1974 | Lowe | 252/33.4 |
| 4,086,172 | 4/1978 | Lowe | 252/32.7 E X |
| 4,210,541 | 7/1980 | Mann | 252/32.7 E |
| 4,283,294 | 8/1981 | Clarke | 252/42.7 X |

*Primary Examiner*—Andrew Metz

*Attorney, Agent, or Firm*—Carl G. Ries; Robert A. Kulason; James J. O'Loughlin

[57] ABSTRACT

A cylinder lubricating oil composition characterized by having a Total Base Number from about 50 to 100 comprising a mineral lubricating oil, from 10 to 20 percent of an overbased calcium sulfonate and an N-alkylglycine derivative having the formula:

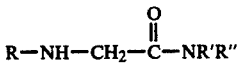

(a)

in which R is a hydrocarbyl radical having from about 10 to 25 carbon atoms, R′ represents hydrogen or an alkyl, hydroxyalkyl or an aminoalkyl radical having from 1 to 5 carbon atoms and R″ represents an alkyl or hydroxyalkyl radical having from 1 to 5 carbon atoms or a $-(CH_2-CH_2-NH)_xH$ radical in which x has a value from 1 to 3, or

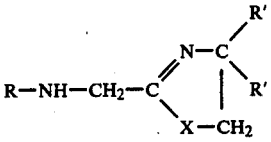

(b)

in which X represents an oxygen atom or a divalent N—R′ radical and R and R′ have the values noted above.

15 Claims, No Drawings

CYLINDER LUBRICATING OIL COMPOSITION

BACKGROUND OF THE INVENTION

Field of the Invention

Energy costs, particularly as illustrated by the cost of crude oil and liquid petroleum distillates derived from crude oil have escalated rapidly. These costs are especially burdensome to the users of transportion fuels, such as shipowners, and these major consumers of petroleum products are reacting to these events and are searching for more efficient measures to use in their operations. One significant development in the shipping field is the trend away from steam turbine propulsion units in favor of large marine diesel engines which are more fuel efficient with respect to petroleum fuels.

The largest marine diesel engines used for ship propulsion are classified as slow speed marine diesel engines. These engines are unique both in their size and in their method of operation. The engines themselves are massive, the larger units approaching 2000 tons in weight and upwards of 100 feet long and 45 feet in height. Their output can reach 50,000 brake horsepower with engine revolutions ranging from about 100 to 125 revolutions per minute.

The slow speed marine diesel engines are also unique in their design. Most notably, the crankcase of the large slow speed single acting 2-stroke crosshead type of engine is completely separate from the combustion chambers of the engine. Because of this, its lubrication requirement differs from that of a typical diesel engine. In particular, the upper cylinder portion of the slow speed diesel engine, not being in direct communication with the crankcase zone of the engine, has it own lubrication system with specific lubrication requirements that differ markedly from the requirements of a crankcase lubricant. In addition, and for reasons of economy, the fuel employed to run the large slow speed diesel engines are residual fuels having relatively high levels of sulfur. This circumstance dictates the employment of a highly overbased lubricating oil composition in order to counteract the acidity generated during the combustion of the sulfur-containing fuel. As a result, a typical cylinder lubricating oil composition for a slow speed marine diesel engine will have an alkalinity level expressed as total base number ranging between about 50 and 100.

The fuel consumption rate of a marine diesel engine of 30,000 horsepower ranges upwards of 1200 gallons of fuel per hour. In view of the current need to reduce overall oil consumption, intensive efforts are being made to discover lubricating oil compositions which can materially reduce the friction losses which take place within the engine itself. Reductions in engine friction losses translate directly into significant fuel savings.

Numerous means have been employed to reduce the friction in internal combustion engines. These range from the use of lower viscosity lubricating oils or mixtures of mineral and synthetic lubricating oils as well as to the incorporation of friction-reducing additives such as graphite, molybdenum compounds and other chemical additives. There are limits to the extent to which the viscosity of a lubricating oil can be reduced for the purpose of reducing friction. Generally, a lubricating oil having too light a viscosity will fail to prevent metal-to-metal contact during high load operating conditions with the result that unacceptable wear will occur in the engine. With respect to chemical anti-friction additives, significant research efforts are ongoing to find effective and economic antifriction additives which exhibit stability over an extended service life and under a wide range of operating conditions.

It is an object of this invention to provide a novel cylinder lubricating oil composition for a slow speed marine diesel engine.

It is another object of this invention to provide a highly overbased marine cyliner lubricating oil having improved friction properties for lubricating a slow speed marine diesel engine.

DESCRIPTION OF THE PRIOR ART

U.S. Pat. Nos. 2,418,012 and 2,810,752 disclose a method for making amide derivatives of N-alkylglycine and their use as laundry detergents.

U.S. Pat. Nos. 3,779,920 and 4,131,551 disclose overbased calcium sulfonates and their use in lubricating oil compositions.

The disclosures of all of the U.S. patents noted here are incorporated herein by reference.

SUMMARY OF THE INVENTION

The cylinder lubricating oil composition of this invention comprises a lubricating oil, an overbased calcium sulfonate having a Total Base Number from 300 to 450 in an amount sufficient to impart a total base number ranging from about 50 to 100 to the lubricating oil composition and a minor amount of an N-alkylglycine derivative represented by the formula:

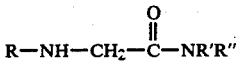

(I)

where R is a hydrocarbyl radical having from about 10 to 25 carbon atoms, R′ represents hydrogen or an alkyl, hydroxyalkyl or an aminoalkyl radical having from 1 to 5 carbon atoms and R″ represents an alkyl or a hydroxyalkyl radical having from 1 to 5 carbon atoms or a $-(CH_2-CH_2-NH)_xH$ radical in which x has a value from 1 to 3, or a derivative represented by the formula:

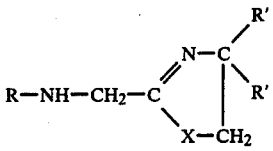

(II)

in which X represents an oxygen atom or a divalent N-R′ radical and R and R′ have values noted above.

The novel method of this invention involves operating a slow speed marine diesel engine by supplying the above-described lubricating oil composition to the upper cylinder lubrication system of said engine.

SPECIFIC EMBODIMENTS OF THE INVENTION

In a more specific embodiment of the invention, the cylinder lubricating composition of the invention will comprise at least 80 weight percent of a mineral lubricating oil, from about 10 to 20 weight percent of an overbased calcium sulfonate sufficient to impart a total base number to the lubricating oil composition ranging between about 50 and 100 and a minor friction modifying amount of an N-alkylglycine derivative selected from the group having the formula:

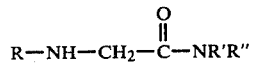

in which R is a hydrocarbyl radical having from about 10 to 25 carbon atoms, R′ represents hydrogen or an alkyl, hydroxyalkyl or an aminoalkyl radical having from 1 to 5 carbon atoms and R″ represents an alkyl or a hydroxyalkyl radical having from 1 to 5 carbon atoms or a $-(CH_2-CH_2-NH)_xH$ radical in which x has a value from 1 to 3, and a derivative represented by the formula:

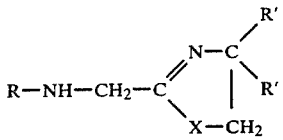

in which X represents an oxygen atom or a divalent N-R′ radical and R and R′ have the values noted above.

A preferred N-alkylglycine-amide friction modifying component of the lubricating oil composition of the invention is represented by the following formula:

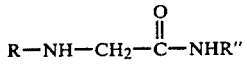

in which R is an alkyl radical having from about 12 to 20 carbon atoms and R″ is a $-(CH_2-CH_2-NH)_xH$ radical in which x has a value from 1 to 2. A still more preferred compound of this type is one in which R has from 16 to 18 carbon atoms.

In general, the essential N-alkylglycine amide of the invention is prepared in two steps involving first the reaction of an aliphatic primary amine with a halogenated acetic acid, such as chloroacetic acid, to form the intermediate N-alkylglycine followed by a reaction of the intermediate N-alkylglycine with an amine to form the prescribed N-alkylglycine-amide.

The aliphatic primary amines which can be employed in the first step of this process are represented by the formula $RNH_2$ in which R is a monovalent saturated or unsaturated aliphatic hydrocarbon or hydrocarbyl radical having from about 10 to 25 carbon atoms. The preferred aliphatic primary amines have from 10 to 20 carbon atoms with the most preferred having from 16 to 18 carbon atoms. The aliphatic primary amines found to be effective are those having essentially straight chain alkyl radicals. Aliphatic monoamines having a minor amount of chain branching, i.e. less than about 5 percent branched alkyl radicals attached to the main straight chain or backbone hydrocarbyl radical can be employed.

Examples of specific aliphatic primary amines suitable for this reaction include n-decylamine, n-dodecylamine, n-tetradecylamine, n-hexadecylamine, n-octadecylamine and aliphatic primary amines derived from natural products, such as coco-amine which averages about 12 aliphatic carbon atoms, and tallow-amine, oleylamine and soya-amine which average about 18 aliphatic carbon atoms.

The aliphatic primary amine is reacted with a halogenated acid represented by the formula:

$$XCH_2-COOH$$

in which X represents a halogen atom, such as chlorine, bromine and iodine to produce an intermediate N-alkylglycine as illustrated below:

$$R-NH_2+XCH_2-COOH \rightarrow R-NH-CH_2-COOH+HX$$

In general, the aliphatic primary amine is dissolved in an inert solvent, such as a hydrocarbon solvent, together with an acid acceptor. The haloacetic acid is gradually added to the mixture and the entire mixture is then heated to its reflux temperature and maintained at this temperature for a sufficient length of time for the reaction to be completed. This intermediate reaction mixture is then cooled.

In the second step, the mixture containing the intermediate N-alkylglycine is reacted with an amine compound which can react with the carboxylic acid group on the N-alkylglycine to form an amide. The amine compound which can be employed in this step of the process is represented by the formula:

$$HNR'R''$$

in which R′ represents hydrogen or an alkyl, hydroxyalkyl or aminoalkyl radical having from 1 to 5 carbon atoms and R″ represents an alkyl or a hydroxyalkyl radical having from 1 to 5 carbon atoms or a $-(CH_2-CH_2-NH)_xH$ radical in which x has a value from 1 to 3. Examples of amines suitable for this step in the process include ethylenediamine, diethylenetriamine, triethylenetetramine, diethanolamine, N-ethylethylenediamine, 1,3-propanediamine, and 2-amino-2-ethyl-1,3-propanediol.

In the final step of the process, the prescribed amine compound is added to the solvent mixture containing the intermediate N-alkylglycine and this new mixture is heated to its reflux temperature and maintained at this temperature until all the water split out in the reaction has been removed. The final reaction product is filtered and stripped of solvent under a vacuum.

The following examples illustrate the preparation of the vital friction reducing additive component of the cylinder oil composition of the invention.

EXAMPLE I

Preparation of N,N-bis(2-hydroxyethyl)-N′-tallow glycine amide 276 parts of a commercial tallow amine (Armeen T-tallow amine) and 53 parts of sodium carbonate were dissolved in a solvent mixture of 400 parts hexane and 400 parts xylene. 94 parts of chloroacetic acid were slowly added to this mixture. The mixture was then heated to reflux temperature and maintained at this temperature until all the water formed in the reaction was removed as an azeotrope. The intermediate reaction product containing N′-tallowglycine was then cooled.

104 parts of diethanolamine was added to the foregoing intermediate reaction product and the new mixture heated to reflux temperature and maintained at this temperature until all of the water of the reaction had been removed as an azeotrope. The final reaction product was filtered and stripped of solvent under a vacuum. The product was analyzed by elemental analysis and IR indicating the preparation of the prescribed product corresponding to the formula:

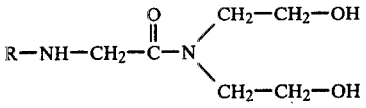

wherein R represents an n-hydrocarbyl radical derived from tallow.

EXAMPLE II

Preparation of N-tallow glycyl amide of ethylenediamine 275 parts of tallow amine (Armeen T), and 53 parts of sodium carbonate were added to a mixture consisting of 400 parts of xylene and 400 parts of hexane. 95 parts of chloroacetic acid were slowly added to this mixture. The mixture was heated to reflux temperature and maintained at this temperature until all the water produced in the reaction had been employed completing the formation of the N-tallowglycine.

60 parts of ethylenediamine were added to the cooled intermediate reaction product prepared above. This mixture was heated to its reflux temperature and maintained at this temperature until all the water of reaction had been removed as an azeotrope. The final product was filtered and stripped of solvent under a vacuum. The product was analyzed by elemental analysis and IR indicating the preparation of N-tallow glycyl amide of ethylenediamine corresponding to the formula:

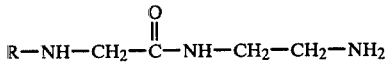

wherein R represents an n-hydrocarbyl radical derived from tallow.

EXAMPLE III

Preparation of N-oleyl glycyl amide of ethylenediamine 264 parts of oleyl amine (Armeen O), and 53 parts of sodium carbonate were added to a mixture consisting of 400 parts of xylene and 400 parts of hexane. 95 parts of chloroacetic acid were slowly added to this mixture. The mixture was then refluxed and maintained at this temperature until all the water produced in the reaction had been removed.

60 parts of ethylenediamine were added to the cooled intermediate reaction product prepared above. This mixture was heated to its reflux temperature and maintained at this temperature until all the water of reaction had been removed as an azeotrope. The final product was filtered and stripped of solvent under a vacuum. The product was analyzed by elemental analysis and IR indicating the preparation of N-oleyl glycyl amide of ethylenediamine corresponding to the formula:

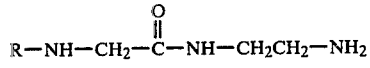

wherein R represents an n-hydrocarbylene radical derived from oleic acid.

EXAMPLE IV

Preparation of N-coco glycyl amide of ethylenediamine 204 parts of COCO amine (Armeen C), derived from coconut oil, and 53 parts of sodium carbonate were added to a mixture consisting of 400 parts of xylene and 400 parts of hexane. 95 parts of chloroacetic acid were slowly added to this mixture. The mixture was then refluxed and maintained at this temperature until all the water produced in the reaction had been removed.

60 parts of ethylenediamine were added to the cooled intermediate reaction product prepared above. This mixture was heated to its reflux temperature and maintained at this temperature until the water of reaction had been removed. The filtered and stripped final product was analyzed by elemental analysis and IR indicating the preparation of N-coco glycyl amide of ethylenediamine corresponding to the formula:

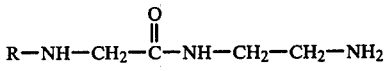

wherein R is predominantly an n-hydrocarbyl radical derived from coco.

EXAMPLE V

Preparation of 1-(2-ethylamine)-2-N-tallow-aminomethyl)imidazoline 275 parts of a primary amine obtained by aminating tallow (Armeen T), 79 parts of pyridine were added to a mixture consisting of 400 parts xylene and 400 parts hexane. 25 parts of chloroacetic acid were added to the mixture. Thix mixture was refluxed for 3 hours and filtered and cooled.

77 parts of diethylenetriamine was added to one-half of the foregoing product mixture and this reaction mixture was heated to reflux and maintained at this temperature until the whole other water separated in the reaction had been azeotroped from the reaction mixture. The final reaction product was filtered and stripped under a vacuum and analyzed by elemental analyses and IR and found to contain 1-(2-ethylamine)-2-(N-tallow-aminomethyl)imidazoline corresponding to the formula:

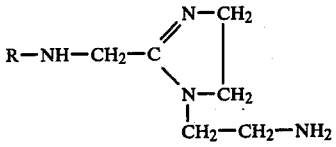

in which R is a hydrocarbyl radical derived from tallow.

EXAMPLE VI

Preparation of 2-(N-tallow-aminomethyl)-4-ethyl-4-methylol-oxazoline 47.5 parts of chloroacetic acid were slowly added to a mixture of 137.5 parts of tallow amine (Armeen T) and 39.5 parts of pyridine in 200 parts hexane and 200 parts xylene. On completion of a chloroacetic acid condition, the reaction mixture was refluxed for 3 hours and then cooled. 59.5 parts of 2-amino-2-ethyl-1,3-propanediol were added to the foregoing intermediate reaction product and the new reaction mixture was heated to reflux and maintained at this temperature until all the water separated in the reaction had been removed. The final reaction product was filtered and stripped and analyzed by elemental analysis and IR to indicate the presence of 2-(N-tallow-aminomethyl)-4-ethyl-4-methylol-oxazoline having the formula:

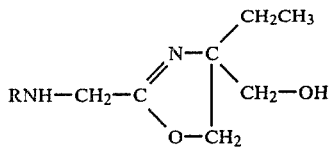

in which R is a hydrocarbyl radical derived from tallow.

The friction modifying component of the cylinder lubricating oil composition of the invention is effective in a range from about 0.2 to 5 weight percent based on the total lubricating oil composition. In general, it is preferred to employ from about 0.5 to 2 weight percent of the n-alkylglycine derivative with the most preferred concentration ranging from about 0.75 to 1.5 weight percent.

The second essential component of the cylinder lubricating oil composition of the invention is an overbased calcium sulfonate having a Total Base Number ranging from 300 to 450 on an active material or neat basis. This component is employed in the finished cyclinder lubricating oil at a concentration ranging from 10 to 20 weight percent based on the weight of the lubricating oil composition and sufficient to provide a cylinder lubricating oil having a Total Base Number from about 50 to 100. A preferred overbased calcium sulfonate has a TBN ranging from about 350 to 425, a preferred concentration of the sulfonate in the lubricating oil is from about 12 to 18 weight percent and a preferred TBN for the lubricating oil composition is from 60 to 80. Total Base Number (TBN) is a measure of alkalinity determined according to the test procedure outlined in ASTM D-664.

Overbased calcium sulfonates can be derived from sulfonic acids or particularly from petroleum sulfonic acids or alkylated benzene sulfonic acids. Useful sulfonic acids from which the overbased calcium sulfonates are prepared can have from about 12 to 200 carbon atoms per molecule. Examples of specific sulfonic acids include mahogany sulfonic acid, petrolatum sulfonic acids, aliphatic sulfonic acids and cycloaliphatic sulfonic acids. Particularly useful alkylated benzene sulfonic acids include polybutylbenzene sulfonic acid, polypropylbenzene sulfonic acid and copolymer propyl 1-butylbenzene sulfonic acids having molecular weights ranging from about 400 to about 900.

The overbased calcium sulfonates are produced by neutralizing the sulfonic acid with a calcium base to form a calcium sulfonate salt and then overbasing the calcium sulfonate with calcium carbonate generally by passing carbon dioxide through a mixture of the neutral calcium sulfonate, mineral oil, lime and water. Methods for preparing overbased calcium sulfonates are disclosed in U.S. Pat. No. 3,779,920 and U.S. Pat. No. 4,131,551 and the disclosures in these references are incorporated herein by reference.

The hydrocarbon base oil which can be employed to prepare the cylinder lubricating oil composition of the invention includes naphthenic base, paraffinic base and mixed base mineral oils, lubricating oil derived from coal products and synthetic oils, e.g., alkylene polymers such as polypropylene and polyisobutylene of a molecular weight of between about 250 and 2500. Advantageously, a lubricating base oil having a lubricating oil viscosity SUS at 100° F. of between about 50 and 1500, preferably between about 100 and 1200, are normally employed for the lubricant composition. The most preferred lubricating viscosity for a cylinder lubricating oil composition is a viscosity ranging from about 68 to 108 SUS at 210° F. The hydrocarbon oil will generally constitute from about 80 to 90 weight percent of the total lubricating oil composition with the preferred concentration range being from about 82 to about 88 weight percent.

The improvement in fuel economy brought about by the novel cylinder lubricant composition of the invention was demonstrated in the Small Engine Friction Test. The Small Engine Friction Test (SEFT) uses a single cylinder, air-cooled, 6-horsepower engine driven by an electric motor. The engine has a cast-iron block and is fitted with an aluminum piston and chrome-plated rings. The electric motor is cradle-mounted so that the reaction torque can be measured by a strain arm. The engine is housed in a thermally insulated enclosure with an electric heater and is driven at 2000 rpm.

Prior to each test, the engine is flushed three times with 1-quart charges of test oil. During the test run, the engine and oil temperatures are increased continually from ambient until a 280° F. oil temperature is reached. The heat comes from engine friction, air compression work and from the electric heater. The engine and oil temperatures and the engine motoring torque are recorded continually during the test. A SEFT run takes about 4 hours. Each test oil evaluation is preceded by a run on a reference oil for a like period of time. The torque reference level for the engine shifts very slowly with time as a result of engine wear. Therefore, the test oil results were recorded compared to a reference band consisting of data from up to three reference runs made before and three runs made after the test oil evaluation.

The frictional effects of the novel cylinder lubricating oil composition of the invention containing the prescribed N-alkylglycine friction modifier was evaluated in a commercial marine cylinder lubricating oil composition. The commercial lubricant or base oil and the modified oil containing the friction modifier of the invention were tested for the friction properties in the Small Engine Friction Test described above. The oil compositions and the test results are set forth in the table below:

EXAMPLE VII

TABLE I

SMALL ENGINE FRICTION TEST RESULTS OF 70 TBN MARINE CYLINDER OIL

| | Marine Cylinder Oil (Base Oil) | Modified Marine Cylinder Oil |
|---|---|---|
| Composition, Vol. % | | |
| Solvent Neutral Oil - SUS at 100° F. of 845 | 38.338 | 37.338 |
| Bright Stock 145, 135-145 SUS at 212° F. | 16.300 | 16.300 |
| 75/80 Pale Oil, 70-77 SUS at 212° F. | 31.550 | 31.440 |
| Overbased calcium sulfonate 400 TBN | 13.800 | 13.800 |
| Corrosion Inhibitor | 0.012 | 0.012 |
| Silicone Antifoamant, ppm | 150 | 150 |

TABLE I-continued

| SMALL ENGINE FRICTION TEST RESULTS OF 70 TBN MARINE CYLINDER OIL | | |
|---|---|---|
| | Marine Cylinder Oil (Base Oil) | Modified Marine Cylinder Oil |
| Product of Example II | | 1.000 |
| Small Engine Friction | | |
| Engine Motoring | | |
| Torque, Ft. Lbs. | | |
| at 280° F. | 3.20 | 2.76 |
| Frictional Improv. | | |
| Overbased Oil, % | — | 13.8 |

(1) Provides 3.0 wt. % Calcium

The foregoing example illustrates the realization of a 13.8 percent reduction in the frictional properties of high TBN marine cylinder oil due to the presence of the N-n-octadecyl glycyl amide of ethylenediamine.

EXAMPLE VIII

A marine cylinder oil is prepared by adding 1 weight percent of the N,N-bis(2-hydroxyethyl)-N'-tallow glycineamide of Example I to the marine cylinder base oil of Example VII.

EXAMPLE IX

A friction modified marine cylinder oil is prepared by adding the 1-(2-ethylamine)-2-N-tallow-aminomethyl-)imidazoline of Example V to the marine cylinder base oil of Example VII.

EXAMPLE X

A marine cylinder oil is prepared by adding 2 weight percent of the 2-(N-tallow-aminomethyl)-4-ethyl-4-methylol-oxazoline of Example VI to the marine cylinder base oil of Example VII.

The foregoing examples illustrate a highly overbased marine cylinder lubricating oil composition for a large slow speed diesel engine which exhibits a substantial improvement in friction properties due to use of the prescribed N-alkylglycine derivatives.

We claim:

1. A cylinder lubricating oil composition having a Total Base Number in the range from about 50 to 100 comprising a major proportion of a mineral lubricating oil, from about 10 to 20 weight percent of an overbased calcium sulfonate having a Total Base Number from about 300 to 450, and a friction modifying amount of an N-alkylglycine derivative selected from the group consisting of (a) an N-alkylglycine having the formula:

$$R-NH-CH_2-\overset{\overset{\displaystyle O}{\|}}{C}-NR'R''$$

in which R is a hydrocarbyl radical having from about 10 to 25 carbon atoms, R' represents hydrogen or an alkyl, hydroxyalkyl or an aminoalkyl radical having from 1 to 5 carbon atoms and R'' represents an alkyl or hydroxyalkyl radical having from 1 to 5 carbon atoms, or a $-(CH_2-CH_2-NH)_xH$ radical in which x has a value from 1 to 3, and (b) an N-alkylglycine derivative having the formula:

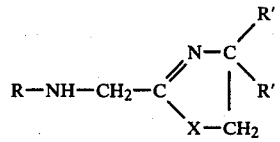

in which X represents an oxygen atom or a divalent N-R' radical and R and R' have the values noted above.

2. A cylinder lubricating oil composition according to claim 1 in which said N-alkylglycine derivative is represented by the formula:

$$R-NH-CH_2-\overset{\overset{\displaystyle O}{\|}}{C}-NHR''$$

in which R is a hydrocarbyl radical having from 12 to 20 carbon atoms and R'' is a $-(CH_2-CH_2-NH)_xH$ radical in which x has a value from 1 to 2.

3. A cylinder lubricating oil composition according to claim 1 in which R in said N-alkylglycine derivative is a hydrocarbyl radical having from 16 to 18 carbon atoms.

4. A cylinder lubricating oil composition according to claim 1 containing from about 12 to 18 percent of an overbased calcium sulfonate having a Total Base Number ranging from 350 to 425.

5. A cylinder lubricating oil composition according to claim 1 containing from about 0.2 to 5 weight percent based on said lubricating oil composition of said N-alkylglycine derivative.

6. A cylinder lubricating oil composition according to claim 1 in which said N-alkylglycine derivative is N-tallow glycyl amide of ethylenediamine represented by the formula:

$$R-NH-CH_2-\overset{\overset{\displaystyle O}{\|}}{C}-NH-CH_2-CH_2-NH_2$$

wherein R represents a hydrocarbyl radical derived from tallow.

7. A cylinder lubricating oil composition according to claim 1 in which said N-alkylglycine derivative is N-coco glycyl amide of ethylenediamine represented by the formula:

$$R-NH-CH_2-\overset{\overset{\displaystyle O}{\|}}{C}-NH-CH_2-CH_2-NH_2$$

wherein R represents a hydrocarbyl radical derived from coconut oil.

8. A cylinder lubricating oil composition according to claim 1 in which said N-alkylglycine derivative is represented by the formula:

$$R-NH-CH_2-\overset{\overset{\displaystyle O}{\|}}{C}-NH-CH_2-CH_2-NH_2$$

in which R is a hydrocarbyl radical derived from oleic acid.

9. A cylinder lubricating oil composition according to claim 1 having a Total Base Number ranging from about 60 to 80.

10. A cylinder luricating oil composition according to claim 1 in which said overbased calcium sulfonate is derived from petroleum sulfonic acids or alkylated benzene sulfonic acids having from about 12 to 200 carbon atoms per molecule.

11. A cylinder lubricating oil composition according to claim 1 in which said N-alkylglycine derivative is N,N-bis(2-hydroxyethyl)-N'-tallow glycine amide.

12. A cylinder lubricating oil composition having a Total Base Number in the range from about 60 to 80 comprising a major proportion of a mineral lubricating oil, from about 12 to 18 weight percent of an overbased calcium sulfonate derived from petroleum sulfonic acids having from about 12 to 200 carbon atoms and having a Total Base Number from about 350 to 425, and a friction modifying amount of an N-alkylglycine derivative having the formula:

$$R-NH-CH_2-\overset{\overset{\displaystyle O}{\|}}{C}-NH-CH_2-CH_2-NH_2$$

in which R is a hydrocarbyl radical having from about 16 to 18 carbon atoms.

13. A cylinder lubricating oil composition according to claim 11 in which the concentration of said N-alkylglycine derivative ranges from about 0.5 to 2.0 weight percent.

14. A cylinder lubricating oil composition according to claim 11 in which the concentration of said N-alkylglycine derivative ranges from about 0.75 to 1.5 weight percent.

15. A cylinder lubricating oil composition according to claim 11 in which said N-alkylglycine derivative of ethylenediamine is represented by the formula:

$$R-NH-CH_2-\overset{\overset{\displaystyle O}{\|}}{C}-NH-CH_2-CH_2-NH_2$$

in which R represents a substantially $C_{18}$ hydrocarbyl radical.

* * * * *